US010166690B2

(12) United States Patent
Siewert

(10) Patent No.: US 10,166,690 B2
(45) Date of Patent: Jan. 1, 2019

(54) APPARATUS FOR PRODUCING CONTAINER CARRIERS

(71) Applicant: ILLINOIS TOOL WORKS INC., Glenview, IL (US)

(72) Inventor: Paul Siewert, Arlington Heights, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/065,352

(22) Filed: Mar. 9, 2016

(65) Prior Publication Data

US 2016/0271825 A1 Sep. 22, 2016

Related U.S. Application Data

(60) Provisional application No. 62/134,416, filed on Mar. 17, 2015.

(51) Int. Cl.

| | |
|---|---|
| ***B26F 1/44*** | (2006.01) |
| ***B26D 7/00*** | (2006.01) |
| ***B26F 1/38*** | (2006.01) |
| ***B41F 19/00*** | (2006.01) |
| ***B26D 7/14*** | (2006.01) |
| ***B26D 7/18*** | (2006.01) |
| ***B65D 71/50*** | (2006.01) |
| ***B65H 75/02*** | (2006.01) |
| ***B26F 1/00*** | (2006.01) |
| ***B41F 5/24*** | (2006.01) |
| *B26D 7/26* | (2006.01) |

(52) U.S. Cl.

CPC ..... *B26F 1/384* (2013.01); *B26D 7/00* (2013.01); *B26D 7/14* (2013.01); *B26D 7/18* (2013.01); *B26F 1/00* (2013.01); *B26F 1/44* (2013.01); *B41F 5/24* (2013.01); *B41F 19/008* (2013.01); *B65D 71/504* (2013.01); *B65H 75/025* (2013.01); *B26D 2007/2607* (2013.01); *B26F 2001/4481* (2013.01)

(58) Field of Classification Search

CPC .. B26F 1/384; B26D 7/00; B26D 7/14; B26D 7/18; B65D 71/504

USPC ..... 83/698.42, 698.21, 649, 659

See application file for complete search history.

(56) References Cited

U.S. PATENT DOCUMENTS

| | | | | |
|---|---|---|---|---|
| 1,459,758 A | | 6/1923 | Symonds | |
| 3,526,163 A | * | 9/1970 | Lowery | B26D 7/1827 206/151 |
| 3,528,330 A | | 9/1970 | Ehlert | |
| 4,831,930 A | * | 5/1989 | Leanna | B26D 7/2614 101/389.1 |
| 5,868,659 A | * | 2/1999 | Slomski | B65D 71/504 206/150 |
| 6,076,444 A | | 6/2000 | Okonski | |

(Continued)

FOREIGN PATENT DOCUMENTS

| | | |
|---|---|---|
| EP | 0 456 359 A2 | 11/1991 |
| GB | 1 231 848 | 5/1971 |
| WO | WO 2014/109914 A1 | 7/2014 |

*Primary Examiner* — Leslie J Evanisko

(74) *Attorney, Agent, or Firm* — Pauley Erickson & Kottis

(57) ABSTRACT

A flexible carrier for carrying a plurality of containers within a plurality of corresponding container receiving apertures is formed using a rotary die within a rotary die press resulting in carriers having complex configurations including close tolerance cuts and complex perforation patterns.

10 Claims, 9 Drawing Sheets

(56) References Cited

U.S. PATENT DOCUMENTS

| | | | | |
|---|---|---|---|---|
| 2004/0005429 | A1 | 1/2004 | Slaters, Jr. | |
| 2005/0112322 | A1* | 5/2005 | Weaver | B65D 71/504 428/131 |
| 2006/0196782 | A1 | 9/2006 | Olsen et al. | |
| 2007/0051218 | A1 | 3/2007 | Dupuis et al. | |
| 2007/0261373 | A1 | 11/2007 | Slovik et al. | |
| 2009/0013830 | A1* | 1/2009 | Pfaff, Jr. | B23P 15/406 76/107.8 |
| 2012/0006212 | A1 | 1/2012 | Demand | |
| 2013/0036881 | A1 | 2/2013 | Slovik et al. | |
| 2013/0305891 | A1 | 11/2013 | Nobukuni | |
| 2014/0102321 | A1 | 4/2014 | Hanauer et al. | |
| 2014/0179503 | A1 | 6/2014 | Rau | |
| 2014/0182429 | A1 | 7/2014 | Saito et al. | |
| 2014/0260851 | A1 | 9/2014 | Beaudry | |
| 2015/0360901 | A1 | 12/2015 | Butterworth | |
| 2016/0016351 | A1 | 1/2016 | Siewert | |
| 2016/0023367 | A1 | 1/2016 | Secondi et al. | |
| 2017/0028579 | A1 | 2/2017 | Drebes et al. | |
| 2017/0106555 | A1 | 4/2017 | Yamamoto et al. | |

* cited by examiner

APPARATUS FOR PRODUCING CONTAINER CARRIERS

CROSS-REFERENCE TO RELATED APPLICATION

This application claims priority to U.S. Provisional Applications, Ser. No. 62/134,416, filed on 17 Mar. 2015. This U.S. Provisional application is hereby incorporated by reference herein in its entirety and are made a part hereof, including but not limited to those portions which specifically appear hereinafter.

BACKGROUND OF THE INVENTION

Field of the Invention

This invention relates to a flexible carrier for carrying a plurality of containers manufactured using a rotary die.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage.

Typically, flexible ring carriers are manufactured in a generally continuous string by feeding an extruded sheet of plastic material, such as low density polyethylene through a vertically reciprocating punch press. As a result, traditional presses punch discrete rows of carriers in which each carrier is connected to adjacent carriers within a row. Depending on the size of the carrier being formed, and the width of the web of carrier material, a plurality of rows may be formed simultaneously in the web of material. To minimize problems associated with indexing variation as the web of material passes through the punch press, adjacent rows of carriers have been punched spaced from each other. As the web passes out of the punch press, the carriers are provided in discrete rows, and are subsequently wound onto separate supply reels or spools or fan folded into boxes.

Marketing demands have tended toward the packaging of more containers in a single package. As a result, there is a demand for larger carriers, such as, for example, twelve-pack carriers in which two arrays of six container receiving apertures are provided on each side of a central web. Even with relatively small containers, a two row twelve-pack carrier of this type is significantly long.

In addition, marketing demands have driven a need for printed container carriers. The printing process has traditionally introduced an added complication into the manufacture of container carriers as the printing often required careful indexing of the punched carrier to print in the proper region of the carrier or has required careful indexing of the punching process to produce container carrier in exact overlay corresponding to printed sheet.

For speed and efficiency in manufacture, it is common to punch at least one entire carrier with each stroke of the press, and index the web forward by at least one carrier length in preparation for the next stroke. As the length of the carriers increases, the indexing stroke increases, and errors in indexing are magnified. An additional problem is that the punched rows of carriers can "wander" exiting the punch press, resulting in misalignment of the unpunched portion of the web, and malformation of portions in subsequent carriers punched in the web.

As can be appreciated, the location, size and shape of the container receiving apertures for holding the containers are critical to proper functioning of the carrier. An undersized, oversized, wrongly located, or malformed container receiving aperture may inadequately retain a container, allowing the container to fall from the carrier. Failure of a carrier in the automatic machinery attaching a carrier to the containers can cause significant difficulties, and significantly curtail output. Failure during transport of the assembled package, at best, is inconvenient As partially described above, punch presses have speed limitations, are noisy, require costly dies, require sophisticated indexing and are limited in the shapes that can be punched at high speeds. There is therefore a need for an alternative method of manufacture for such plastic ring carriers.

SUMMARY OF THE INVENTION

The present invention is directed to a flexible carrier for packaging containers that is manufactured using a rotary die and a rotary die press. According to preferred embodiments of this invention, a sheet of plastic material is directed through a rotary die press and three or more rows or "lanes" of container carriers are formed in a generally continuous manner.

The resulting carrier may include complex detail, close tolerance cuts, complex perforation patterns, including non-linear perforations, all with less scrap. Indexing complex multi-lane container carriers is also no longer an issue with the invention as described herein.

In addition, the carrier according to this invention may be printed in process eliminating the need to re-index in post-processing. As such, a sheet of carrier material may be fed into a machine according to this invention and then printed and cut to form a generally continuous string of printed container carrier.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
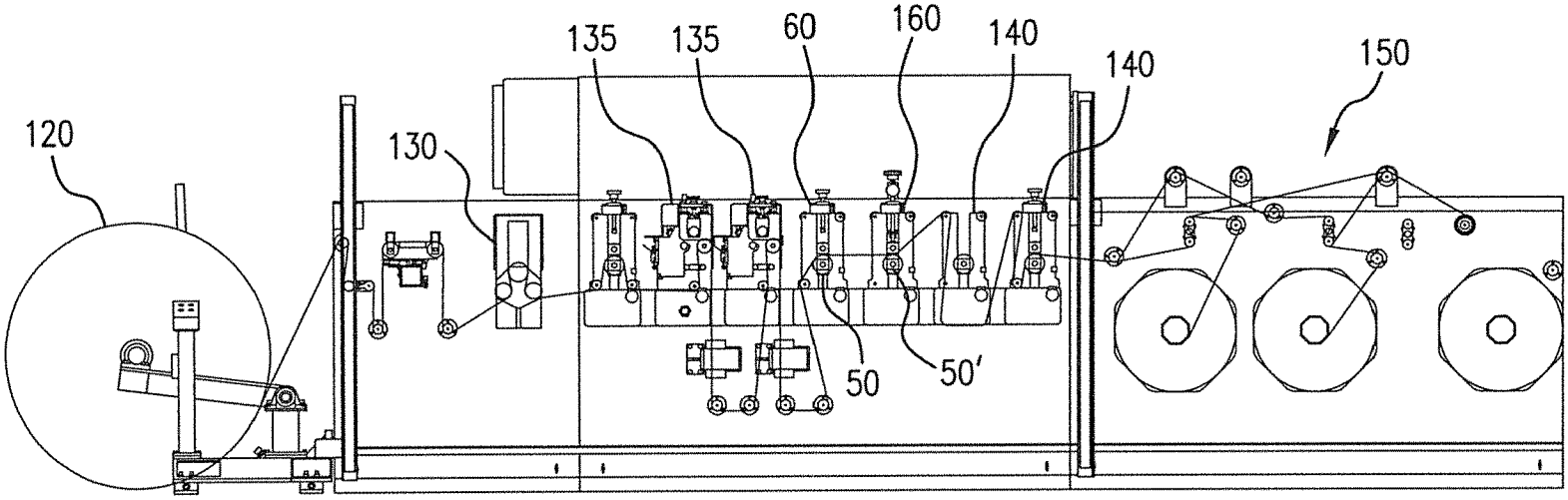
FIG. 1 is a side view of a rotary die press according to one preferred embodiment of this invention.

FIG. 1 shows a side view of one embodiment of a rotary die press for forming a plurality of flexible containers and a resulting unitized package. FIGS. 2-5 and 10 show various embodiments of a suitable rotary die and die plate and FIG. 6-9 show various embodiments of flexible carriers 10 manufactured with the rotary die according to embodiments of this invention. However, these drawings are exemplary, and the invention is not limited to the flexible carriers 10 or rotary die shown. For example, the flexible carrier 10 may be alternatively configured and used to unitize six, eight or any other desired number of containers.

According to one preferred embodiment of this invention, such as shown in FIG. 1, one or more layers of flexible plastic sheet are fed into a rotary die press 60 to form the carrier through a rotary die 50 that punches the desired configuration. Such carriers are preferably formed in three or more rows or "lanes" of container carriers and are formed in a generally continuous manner. According to a preferred embodiment of this invention, a second rotary die press 160 with a second rotary die 50' is positioned downstream of the rotary die press 60 and between the rotary die (first) and the second rotary die 50', alternating carriers are punched in a generally continuous manner.

A preferred embodiment of the rotary die 50 used in accordance with this invention is manufactured using D2 hardened tool steel but can be manufactured from a variety of tool steels and powdered metal alloys. Such rotary dies are preferably single piece dies and include one or more curved blades forming a periphery and internal detail features of the container carriers 10 to be punched. Such detail features may be positioned in close proximity to each other in the rotary die and may include tightly radiused corners, non-linear perforations, cuts formed right up to a periphery of the carrier and closely adjacent details.

Figure 2:
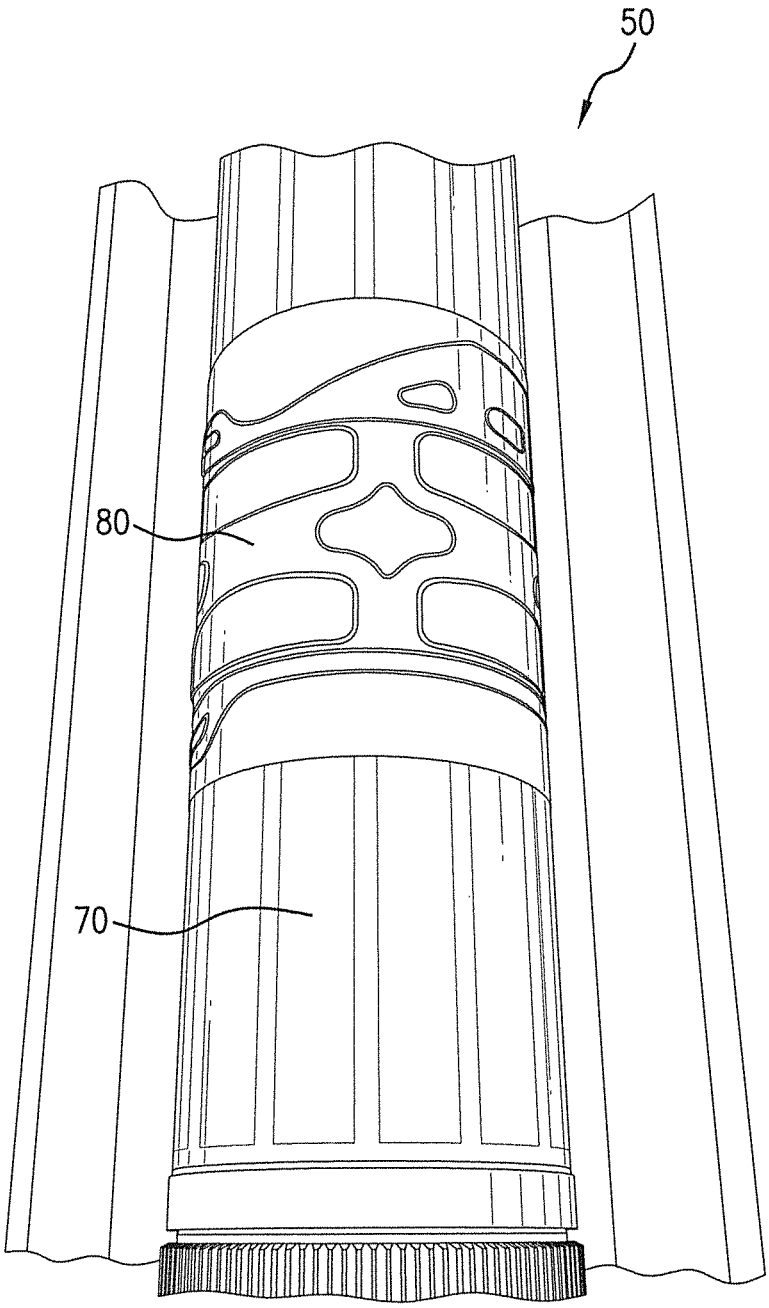
FIG. 2 is a top view of a magnetic die plate and a rotary die in accordance with one preferred embodiment of this invention.
Figure 3:
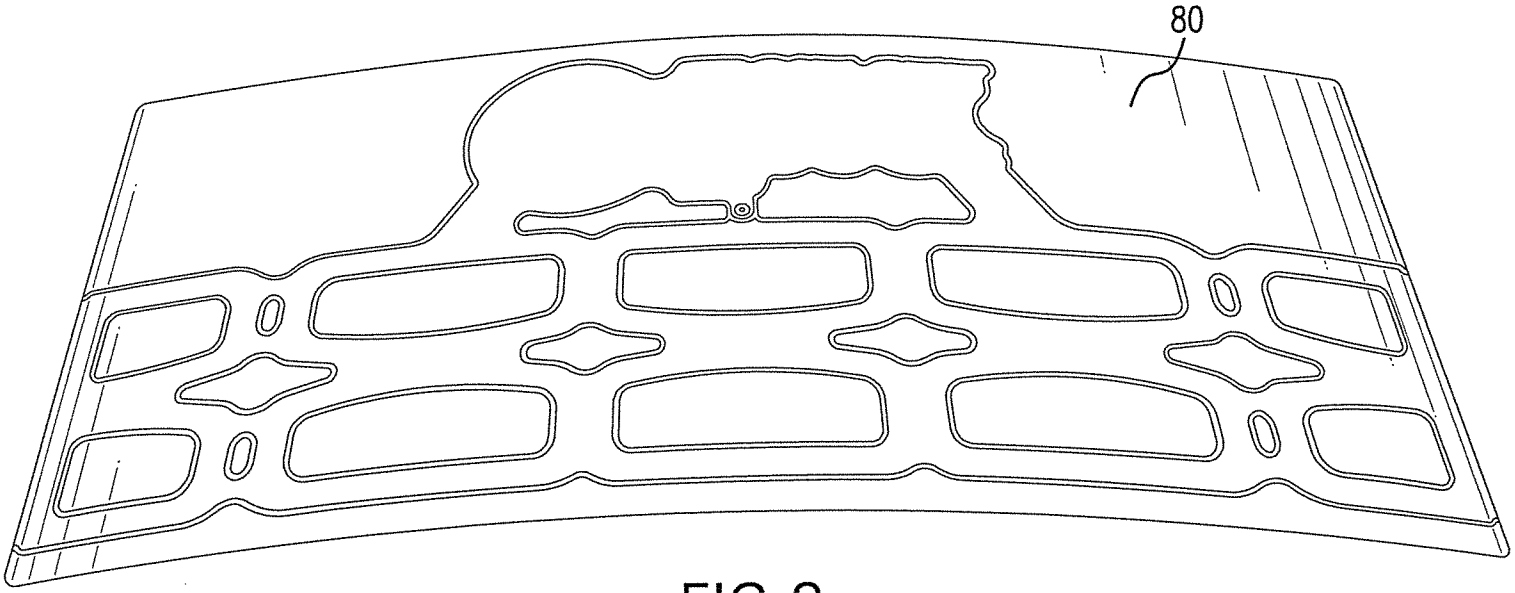
FIG. 3 is a top view of a magnetic die plate in accordance with one preferred embodiment of this invention.

As described above, rotary web converting is preferably accomplished using "hard tooling," not shown. These tools are intended for long run (millions of revolutions), high speed, and high precision cutting operations. One alternate type of low cost, low volume, lower quality type of cutting equipment are flexible magnetic dies such as shown in FIGS. 2 and 3 which are used in association with rotary die equipment as described herein. These flexible plates 80 can be manufactured in a fraction of the time it takes to manufacture hard tooling. The cost for these flexible plates 80 is also a fraction of what it costs for hard tooling. As used herein, "rotary die 50" may comprise hard tooling or a combination of a cylinder 70 and a die plate 80, wherein at least one of the cylinder 70 and the die plate 80 are preferably magnetic for adherence.

Figure 4:
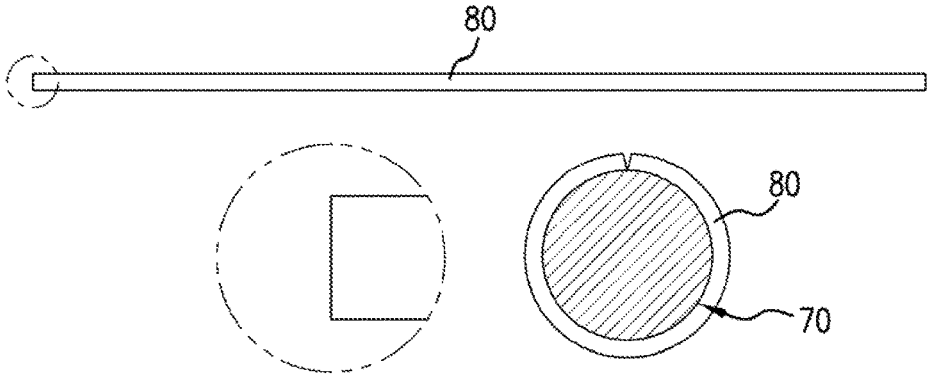
FIG.4 Prior Art
FIG. 4 is a schematic side view of a traditional assembly of a magnetic die plate.
Figure 5:
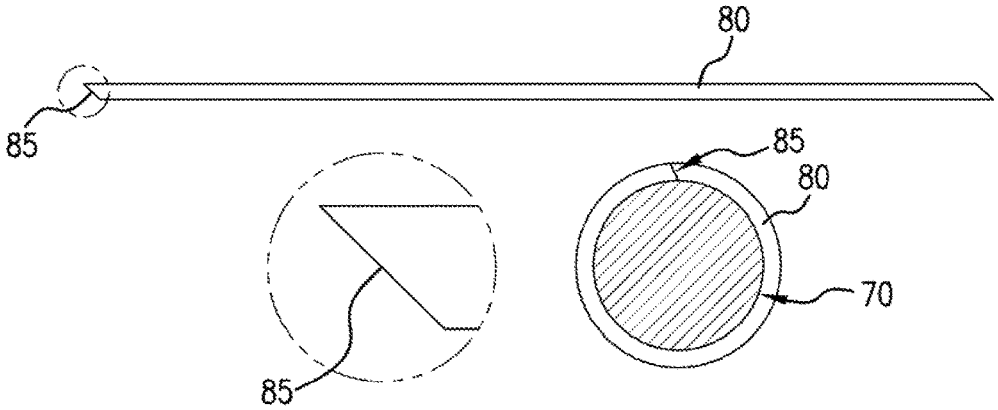
FIG. 5 is a schematic side view of an assembly of a magnetic die plate having a pair of beveled edges in accordance with one preferred embodiment of this invention.

The flexible plates 80 such as shown in FIGS. 2-6 are preferably installed onto cylinders 70, such as shown in FIGS. 2, 4 and 5, that are then installed into a rotary press 60 within a web converting machine in much the same way a hard tool is installed. As described above, at least one, or both, of the cylinder 70 and the plate 80 are magnetic. A difficulty with flexible plates 80 is that a continuous cut is not as feasible as it is with hard tooling. A generally continuous flexible carrier is unique to the rotary web converting world because carriers are generally sold as a continuous single-ply web. Traditionally, the web comprises the scrap of a rotary operation.

A traditional magnetic plate 80 is shown in FIG. 4 having squared off edges because in traditional punching processes, there is no need or desire to maintain a continuous web, the web is discarded and the punched components traditionally contain the commodity. In order to simulate a continuous cut and allow for efficient slug removal, an edge profile of the magnetic plate may be angled or beveled 85 to get the blades closer together, such as shown in FIG. 5.

Figure 6:
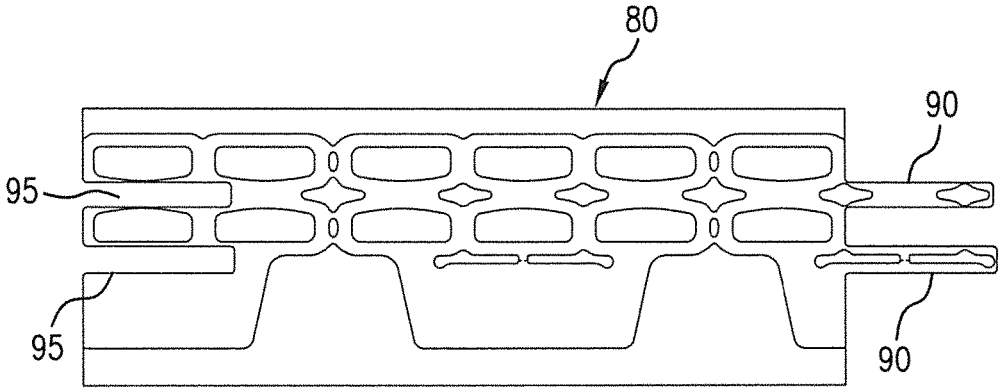
FIG. 6 is a side elevational view of a carrier produced in accordance with one preferred embodiment of this invention.
Figure 7:
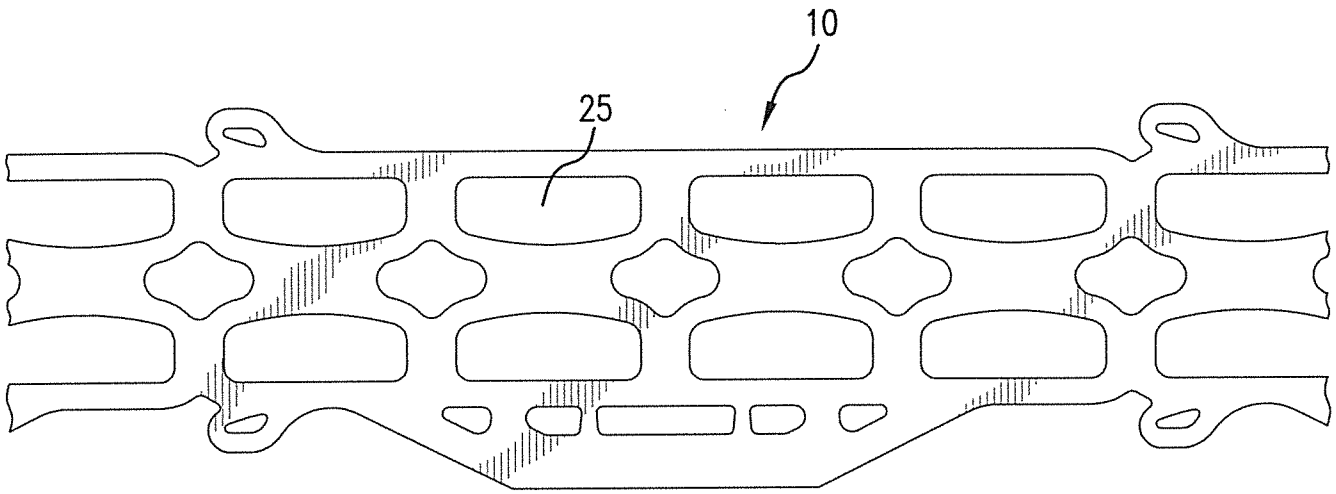
FIG. 7 is a side elevational view of a carrier produced in accordance with one preferred embodiment of this invention.
Figure 8:
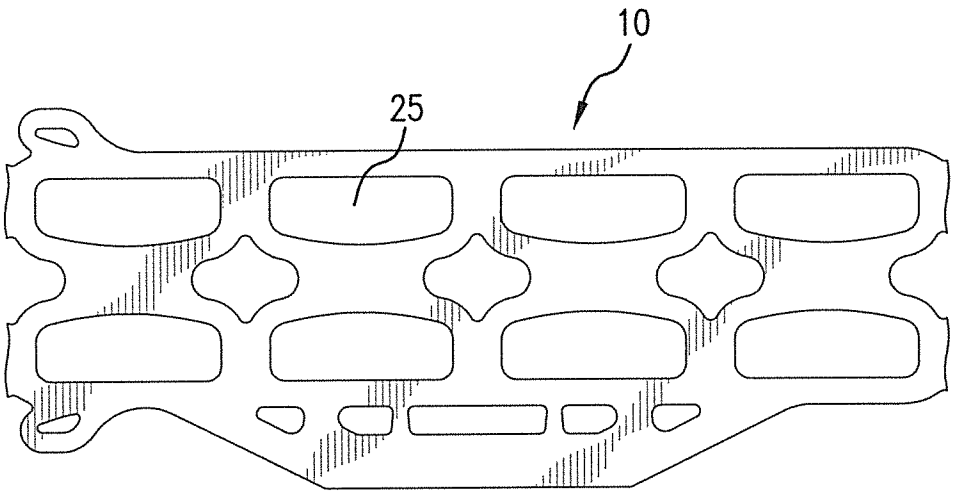
FIG. 8 is a side elevational view of a carrier produced in accordance with one preferred embodiment of this invention.
Figure 9:
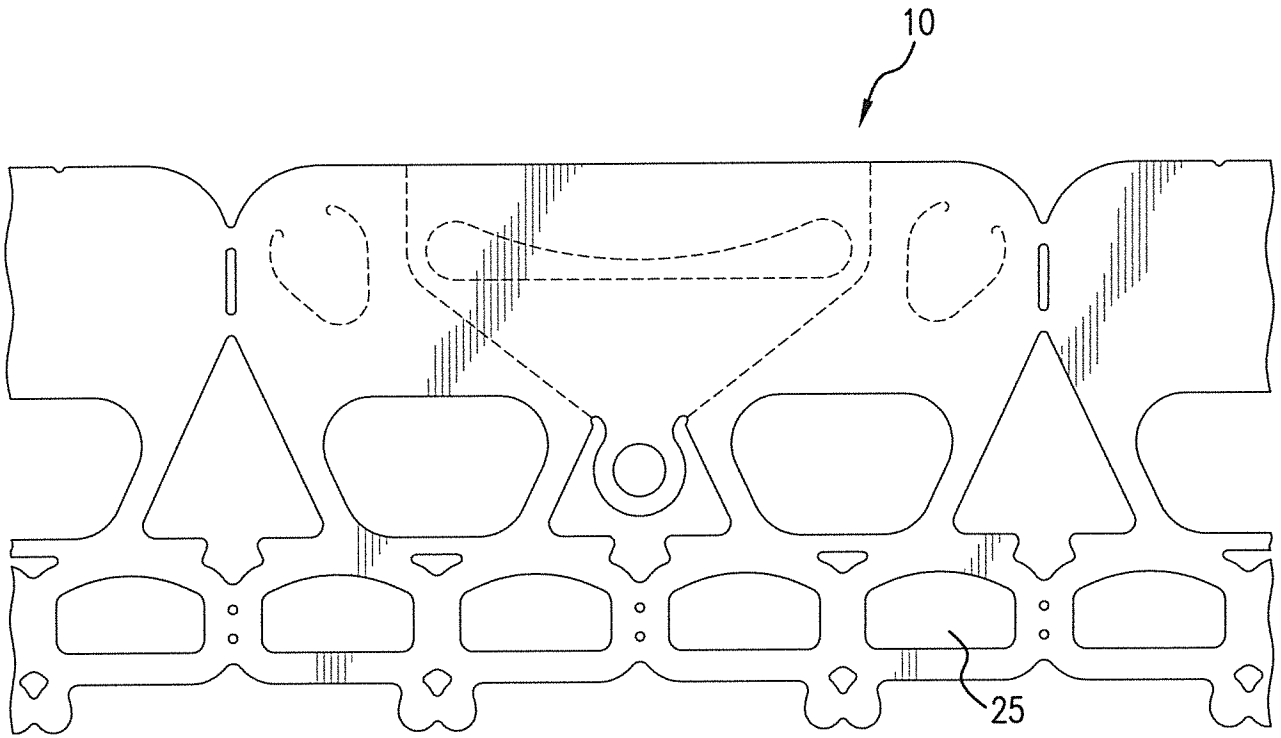
FIG. 9 is a side elevational view of a carrier produced in accordance with one preferred embodiment of this invention.
Figure 10:
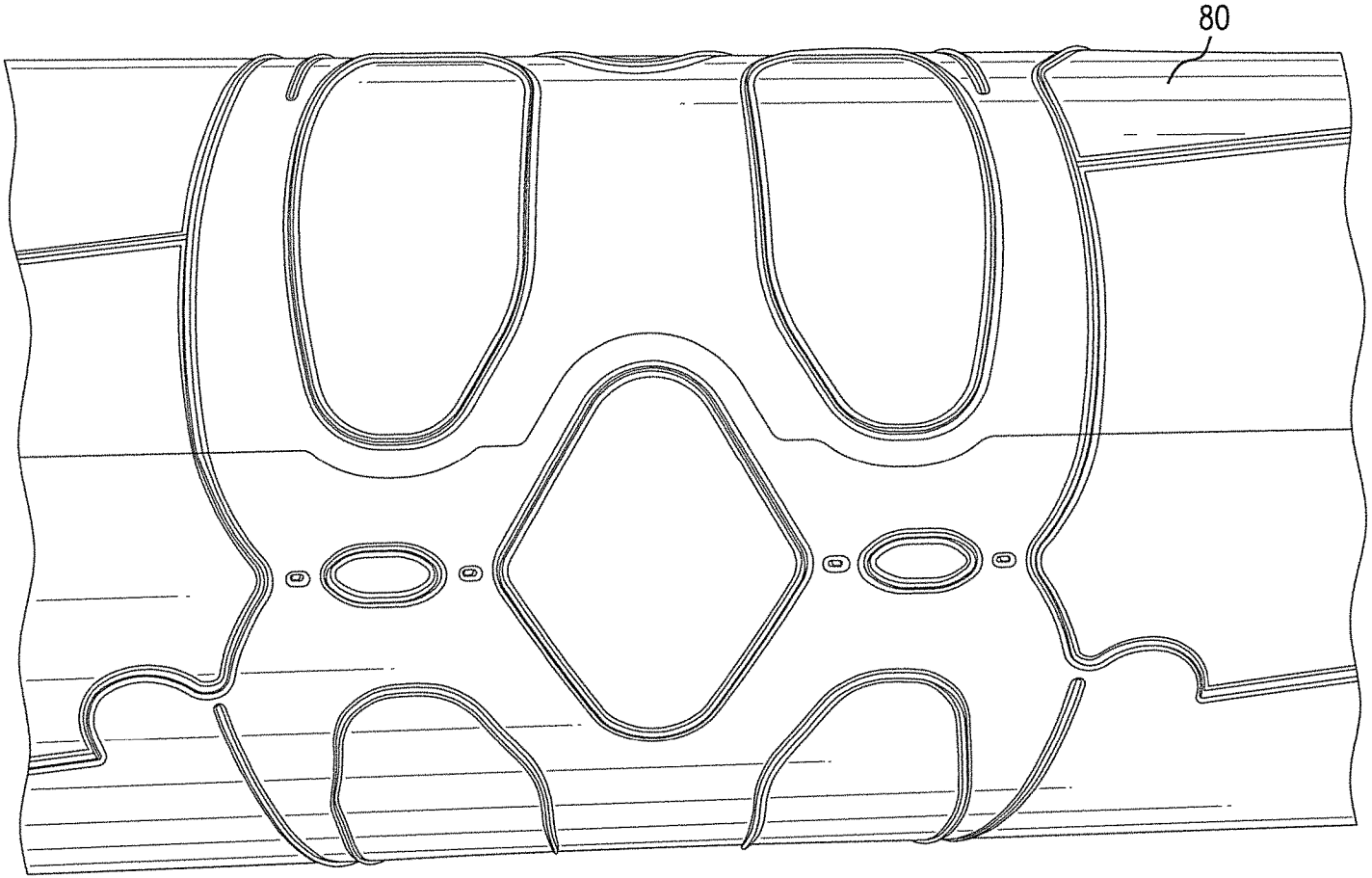
FIG. 10 is a side view of a magnetic plate having a finger and groove nesting arrangement in accordance with one preferred embodiment of this invention.

This beveling of the plate edge shown in FIG. 5 enables a continuous web cutting using a magnetic plate. However, a problem may still arise when cutting a plate straight through a carrier feature. Regardless of how close the adjoining blades are around the cylinder, the result is still two blades from opposite edges of the material touch the slugs and tend to stick to the carrier. The subject invention solves this problem, in part, by cutting the flexible plate in a way that only intersects the outside trim edges of our carriers. FIG. 6 demonstrates how fingers 90 machined out of the plate would nest inside of the grooves 95 on the opposite side.

The resulting carrier may include complex detail, close tolerance cuts, complex perforation patterns, including non-linear perforations, all with less scrap. Indexing complex multi-lane container carriers is also no longer an issue with the invention as described herein. Various embodiments of such carriers are shown in FIGS. 6-9.

The rotary die press preferably includes an infeed for the plastic sheet; a rotary die for forming a generally continuous string of carriers from the plastic sheet; one or more winding and unwinding modules 120 for transferring the plastic sheet and/or the generally continuous string of carriers through the rotary die 50 at a desired speed and tension; one or more waste modules 140 for evacuating and redirecting scrap generated from the punching process; and an outfeed for transferring the generally continuous string of carriers from the rotary die press to a collection station 150, such as a reel stand for rolling spools or reels of the generally continuous string of carriers or a box for fanfolding the generally continuous string of carriers. As used herein, the term "module" may include an integrated feature of the rotary die press or a separate component for accomplishing the described purpose.

The package resulting from the flexible carrier 10 includes a plurality of unitized flexible containers. Flexible carriers 10 are generally applied to containers by stretching the flexible sheet surrounding the container receiving apertures 25 around containers, and requiring the stretched carrier 10 to recover, thereby providing a tight engagement.

The carrier web path when using flexible plates is identical to the path used for hard rotary tooling, such as shown in FIG. 1. The rotary web converting machine unwinds coils of plastic sheet into the machine at a speed that is maintained by a dancer arm. As the machine speeds up and the coil is not unwinding fast enough, the dancer rotates, signaling the coil unwinder to speed up. The operation is opposite when the machine slows down and the coil is unwinding too fast. The material is then fed through a web steering guide that keeps the material from shifting even if the coil is unwinding unevenly. This is important when printing on the material and registering a cut to that print. If the sheet moves laterally to machine direction, the print will always be off registration.

The next piece of equipment is preferably a corona treater 130. Corona treating is also known as air plasma treatment. This treatment helps increase the surface tension of the sheet to allow for better ink adhesion in the printers later on in the machine. This process also provides the added benefit of burning off the slip additive in the low density polyethylene material. Slip "blooms" to the surface within a couple of days of extruding the sheet and interferes with printing if not removed.

The next piece of equipment on the machine is preferably a nip roller. This is a rubber coated roller that applies force to the material and is sped up or slowed down relative to the material speed in order to create and maintain tension. Proper tension is critical to both web guiding and cutting. If the material has slack it will wonder back and forth. If the web is too tight it will break after we cut out our carrier shape.

The material then preferably travels between two flexographic printers 135. Each printer 135 can lay a different color down onto our material. The first printing station will always lay down the printed image as well as a registration mark or "eye-mark". A registration mark sensor between flexographic printer station one and two will communicate with the machine so the second printer knows exactly where the ink is from printer one. Without this registration mark, the printed images would not properly line up.

After the second printer 135 the material goes through another nip roller. Tension is maintained between the first and the second nip roller so the material has the proper tension for printing. The material then preferably goes through the die cutting station(s) 60, 160. The die cutting stations or rotary presses 50, 50' include either a hard tool rotary die 50 or a flexible magnetic die assembly of a cylinder 70 and plate 80. If the material has been printed on, a registration sensor right before the die will sense the printed registration mark on the material and adjust the speed or "offset" of the die in order to line the die up with the printed image. If there is no printing on the material, no sensor is needed. The die is instead set to a desired gear ratio that will output a carrier of the correct length.

The flexible sheet material runs between the die and an anvil. Hydraulic pressure is preferably applied to the top of the rotary die in order to cut through the material. As the finished product comes out of the die the path that the carrier follows inside the machine is critical to slug removal. The material preferably comes out of the die between a 20 and 50 degree angle to ensure the air eject features inside the die can have a surface to push against. Any slugs that are not ejected properly are hit with additional air knives and air nozzles to help remove them. The bends and turns in the web path also assist with slug removal.

The next piece of equipment in the machine is preferably a nip roller. This nip roller controls the tension between the second and third nip rollers where the die is. Too much tension after the die will break the web and too little will cause slack to build up and clog the slug removal vacuum. After the last nip roller the carrier is rewound on a shaft holding an empty reel. The shaft is linearly variable allowing us to "level wind" our product. As the product winds the shaft moves in and out at whatever rate and frequency we enter into the machine. This allows us to get the optimum quantities on our reels.

While in the foregoing specification this invention has been described in relation to certain preferred embodiments thereof, and many details have been set forth for purpose of illustration, it will be apparent to those skilled in the art that the flexible carrier 10 and the rotary die and rotary die press are susceptible to additional embodiments and that certain of the details described herein can be varied considerably without departing from the basic principles of the invention.

The invention claimed is:

1. An apparatus for producing container carriers comprising:

an unwinder providing a generally continuous sheet of plastic material;

a rotary die including a cylinder and a plate wrapped around the cylinder, the plate having a nested edge, wherein the nested edge comprises a finger on one edge of the plate and a receiving groove on an opposite edge of the plate wherein the finger nests within the receiving groove when the plate is wrapped around the cylinder, wherein the rotary die includes one or more curved blades and is configured to punch the plastic material into a generally continuous string of three or more rows of container carriers;

an outfeed for transferring the generally continuous string to a collection station.

2. The apparatus of claim 1 wherein at least one of the cylinder and the plate are magnetic.

3. The apparatus of claim 1 further comprising a second rotary die including a second cylinder and a second plate.

4. The apparatus of claim 3 wherein the rotary die punches a container carrier and the second rotary die punches an adjacent. container carrier.

5. The apparatus of claim 1 further comprising a printer positioned inline with the rotary die, the printer for printing at least one of color, text or product information on the container carrier.

6. The apparatus of claim 5 wherein the printer does not print on scrap material that is ejected from the generally continuous string of container carriers.

7. The apparatus of claim 1 Wherein the plate is printed from edge to edge.

8. The apparatus of claim 1 wherein the container carriers include a nonlinear perforation.

9. The apparatus of claim 1 further comprising at least one waste module for evacuating scrap from the generally continuous string.

10. The apparatus of claim 1 further comprising a corona treater positioned upstream of the rotary die.

* * * * *